United States Patent [19]

Regebro

[11] Patent Number: 4,498,394

[45] Date of Patent: Feb. 12, 1985

[54] ARRANGEMENT FOR A TERMINALLY GUIDED PROJECTILE PROVIDED WITH A TARGET SEEKING ARRANGEMENT AND PATH CORRECTION ARRANGEMENT

[75] Inventor: Christer Regebro, Eskilstuna, Sweden

[73] Assignee: Forenade Fabriksverken, Eskilstuna, Sweden

[21] Appl. No.: 439,026

[22] Filed: Nov. 4, 1982

[30] Foreign Application Priority Data

Nov. 12, 1981 [SE] Sweden ..... 8106719

[51] Int. Cl.[3] ..... F42B 13/24; F42B 13/50

[52] U.S. Cl. ..... 102/489; 102/378; 102/490

[58] Field of Search ..... 102/489, 378, 393, 394, 102/489, 490, 520, 521, 522; 244/3.22, 3.23, 3.28

[56] References Cited

U.S. PATENT DOCUMENTS

| | | | |
|---|---|---|---|
| 2,091,635 | 8/1937 | Hayden | 102/490 |
| 4,372,216 | 2/1983 | Pinson et al. | 102/489 |
| 4,417,520 | 11/1983 | Maudal | 102/489 |

FOREIGN PATENT DOCUMENTS 356956 6/1971 Sweden .

OTHER PUBLICATIONS

*Ammunition (Including Grenades & Mines),* Goad and Halsey, Brassey's, (1982).

*Guns, Mortars & Rockets,* Ryan, Brassey's, (1982).

*Primary Examiner*—Charles T. Jordan

*Assistant Examiner*—Ted L. Parr

*Attorney, Agent, or Firm*—Fleit, Jacobson, Cohn & Price

[57] ABSTRACT

Arrangement for a terminally guided projectile provided with a target seeking arrangement and path correction arrangement. The arrangement includes a preferably fin-stabilized, slowly-rotating artillery shell which is provided with an elongated cavity into which the terminally guided projectile, which comprises a fin-stabilized mortar projectile, is introduced. The mortar projectile is arranged so that it is ejected rearwards from the artillery shell by means of a separation charge in the vicinity of a selected target, after which the mortar projectile is terminally guided towards the target in a manner known per se.

9 Claims, 1 Drawing Figure

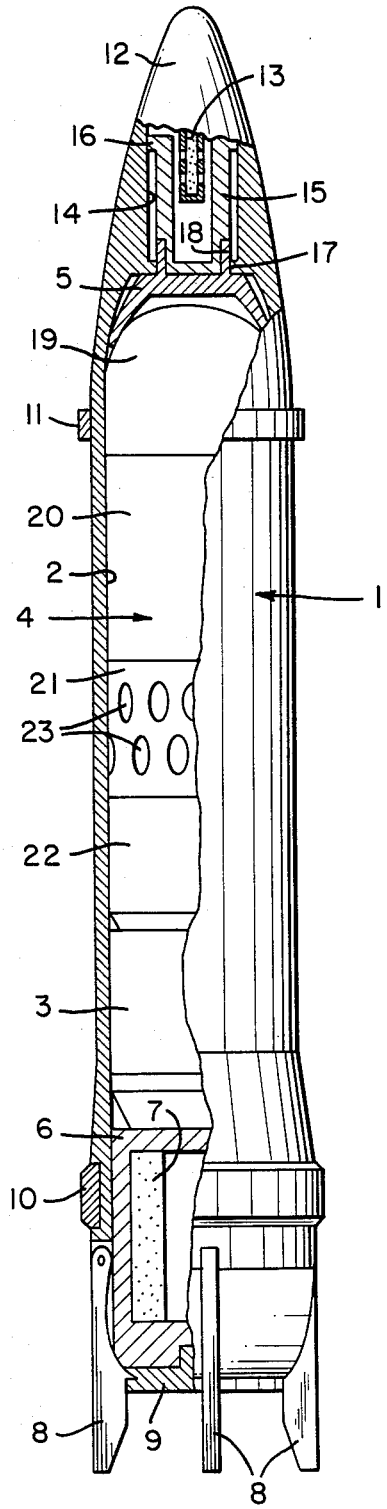
12
13
16
15
14
18
17
5
19
11
20
2
1
4
21
23
22
3
7
6
10
8
9
8

ARRANGEMENT FOR A TERMINALLY GUIDED PROJECTILE PROVIDED WITH A TARGET SEEKING ARRANGEMENT AND PATH CORRECTION ARRANGEMENT

The present invention relates to an arrangement for a terminally guided projectile provided with a target seeking arrangement and path correction arrangement.

Developments within the artillery sphere have rendered possible projectiles with increased range, e.g. with the aid of base bleed units. However the increased range results in increased absolute scatter of the projectiles. This increased scatter is very unfavourable, particularly since a change in the threat pattern has become reflected in a greater frequency of smaller and more difficult elementary targets where each elementary target has to be fought. To reduce the scatter of the projectiles terminal correction or terminal guidance of the projectiles has been proposed. This involves a projectile being fired in a ballistic path in the conventional manner, but at the end of the path a target seeking element and path correction element are activated which can guide the projectile to a hit or near hit on the target. Compared with the radical replacement of conventional artillery by guided missiles, a system with terminally corrected projectiles is less complicated than a guided missile, because continuous guidance is not utilised. Furthermore it is more difficult to interfere with the projectile because this follows a ballistic path for a large portion, or the majority, of its flight.

Various systems have been presented for terminal guidance projectiles. Conventional artillery ammunition is spin-stabilized throughout the entire trajectory, i.e. it has a high speed of rotation (of the order of 300–2000 rad/second). Proposals have been put forward for terminal guidance of projectiles which are spin-stabilized throughout their entire trajectory. The advantage of such a system is that a completely conventional firing can be undertaken using ammunition powers which differ very little in size and weight from conventional ammunition. Disadvantages are the extremely complicated guidance and the restricted range of manoeuverability, also the very uncertain implementation.

The target seeker becomes complicated and considerable difficulties arise in course correction because the roll position of the projectile must be established when the control signal is given. It has been suggested that the direction of roll be established relative to a reference direction with the aid of a rate gyro and integration. However this proposal is not without its problems because the gyro is sensitive in respect of acceleration and can drift. In the case of projectiles which are fired from a gun barrel the sensitivity towards acceleration is particularly a major problem.

Hence a spin-stabilized projectile is certainly unsuitable for use as terminally guided projectile or more generally if the projectile is to carry, for example, an explosive charge with a hollow-charge effect, in which the explosive pattern is noticeably affected if the explosive charge rotates.

In the majority of systems presented hitherto of terminally guided projectiles the projectile is provided with a slipping band, with the result that the projectile has low speed of rotation (about 0–200 rad/sec) when it leaves the barrel muzzle. This means that stabilizing fins have to be extended outwards directly on leaving the muzzle. The advantage of this system of low or no speed of rotation in the trajectory is that target seeking and guidance can be fairly simple. Certain warheads, such as explosive charges with a hollow charge effect, as mentioned above furthermore require low speed of rotation so as to achieve a good effect. The disadvantage of this system is that the range is negatively affected.

Another solution to the final phase guidance problem is to employ fin-stabilized mortar projectiles which can easily be provided with a shape which aerodynamically is particularly favourable for the target seeker and terminal guidance. Mortar projectiles have however a relatively short range.

The aim of the present invention is to provide an arrangement of the type mentioned in the preamble by means of which two fundamentally conflicting requirements are satisfied by the terminally guided projectile, namely that this should on the one hand have the good terminal guidance characteristics of the fin stabilized mortar projectile, and secondly the long range of the spin-stabilized projectile. This objective is achieved in that the arrangement in accordance with the invention has the characteristics specified in claim 1. Further developments of the invention are described in the subclaims.

The invention will be described in greater detail by reference to the drawing which provides a longitudinal section, partially in view, of a preferred embodiment of the arrangement in accordance with the invention.

In the drawing a fin stabilized artillery shell 1 is illustrated which has a central, elongated cylindrical cavity 2 which is open at the rear. A mortar projectile 4 with terminal guidance and provided with stabilizing fins 3 is introduced into the cavity 2 between a cup-shaped protective casing 5, the function of which will be explained later, and a conventional base bleed unit 6.

The base bleed unit 6 is attached, in a manner which is not illustrated, to the rear end of the wall of the artillery shell 1. The attachment can take place for example by threaded connection or locking pin. The base bleed unit 6 which is provided with a slow-burning powder charge 7, gives an increased range by giving off gas from the powder charge 7, in a known manner, which occupies the vacuum at the rear end of the artillery shell 1.

The rear portion of the artillery shell 1 has four fins 8, placed on edge, which in the retracted position are kept in position by a sealing washer 9 further to the rear in the artillery shell 1. The washer 9 is provided in a known manner with through holes (not shown), which together with corresponding holes (not shown) in the rear wall of the base bleed unit 6 permit the passage of the propellant charge gases from the barrel, not shown, of a howitzer or similar firing device, as a result of which these gases ignite the slowly burning powder charge 7. When the shell 1 leaves the barrel, the gases from the powder charge 7 flow out through the said holes in the base bleed unit 6 so as to bring about the said vacuum to the rear of the shell.

At its rear portion, in front of the fins 8, the artillery shell 1 is provided with a slipping band 10, and at its front end with a guide band 11 which is arranged to be dropped away in a known manner when the shell 1 leaves the barrel. The shell 1 is ejected in the conventional manner from a gun with rifled barrel, so that the slipping band 10 transmits only a slight rotation, which is less, and preferably considerably less, than 200 rad/- sec, to the shell 1. The use of such a band which rubs agains the rifling of the barrel has long been known and employed so that it has not been considered necessary to illustrate either the barrel or the barrel rifling in the drawing.

A fuse 12 in the nose of the artillery shell 1 is arranged to ignite a separation charge in the form of a powder charge 13 a certain time after the shell 1 has been fired. The fuse 12 which is of the conventional type does not form part of the present invention and hence is illustrated only schematically.

To the rear of the powder charge 12 there is a cylindrical cavity 14 in which a piston 15 can move under the influence of the powder gases from the charge 13. At its forward end, viewed in the direction of ejection of the projectile 1, the piston 15 has a ring-shaped flange 16 which, in the event of a predetermined movement of the piston 15, impacts against a ring-shaped shoulder 17 in the cavity 14 and by this means restricts the movement of the piston 15 to the rear in the cavity 14.

The rear end piston 15 is threaded firmly onto a tubular projection 18 on the above-mentioned protective cover 5. The protective cover 5 surrounds the nose on the mortar projectile 4 and is designed on the one hand to protect sensitive target seeking optics arranged inside it and secondly to act as a type of sabot during the ejection of the mortar projectile 4 from the artillery shell 1.

Starting from the front the mortar projectile 4 consists of a target seeking section 19 (e.g. of the IR or mm-wave type), an electronics and battery section 20, a path correction section 21 and a warhead section 22. The path correction section 21 has, around its casing surface, a plurality of uniformly distributed gas discharge apertures 23 which are arranged to release, in a controlled manner, the path correcting gas impulses from a gas generator, not shown, which is present in the path correction section 21. The rear portion of the charge section 22 carries the previously mentioned stabilizing fins 3, which in the embodiment shown are made up of "wrap-around fins".

The various components 19–22 form part of state of the art and since their detailed function and composition does not form part of the fundamental inventive concept, they will not be described here. In order to understand the function of the shell 4, it should however be mentioned that the battery section 20 is arranged so that it is activated in a known manner by the acceleration forces to which it is subjected during the firing of the artillery shell 1. Furthermore the target seeking section 19 is arranged so that in a known manner it starts to seek the target a predetermined time after the mortar projectile 4 has left the artillery shell 1. Sensing of the firing of the mortar projectile 4 can occur for example by sensing of the movement of the mortar projectile 4 relative to that of the artillery shell 1, or in some other known manner.

The function of the embodiment of the arrangement in accordance with the invention illustrated here is as follows.

When the artillery shell 1 is fired from a howitzer or the like which has a rifled barrel, the band 10 imparts a slight rotation to the artillery shell 1 which ensures that the shell does not drift sideways or vertically. The fins 8 are extended as soon as the shell 1 has left the barrel. Extension can take place by means of springs, pistons or the like, which are not shown, or by means of the direct or indirect effect of the propellant charge gases on the fins.

After the powder charge 7 in the base bleed unit 6 is burned out, the fuse 12 will after a predetermined time initiate the ignition of the powder charge 13. The gases from this push the piston 15 and by this means the sabot 5 to the rear. As a result the mortar projectile 4 together with the now burnt out base bleed unit 6 located to the rear of this are fired rearwards from the artillery shell 1.

Because the mortar projectile 4 is ejected rearwards, its velocity is reduced somewhat. However this is an advantage because during its terminal guidance the mortar projectile 4 should have a lower velocity (about 250–300 rad/sec) than the artillery shell 1 which has much too high a velocity for terminal guidance.

At least initially the mortar projectile 4 which has been fired has the same speed of rotation as the artillery shell 1. However it is possible to have the mortar projectile 4 mounted, e.g. by means of a slipping bearing, so that no rotation or hardly any rotation is transmitted from the artillery shell 1 to the mortar projectile 4.

After the mortar projectile 4 has left the artillery shell 1, the target seeking section 19 is activated after a predetermined time in the manner previously explained, after which the target seeking section 19 guides the mortar projectile 4 to the selected target.

Although in accordance with the embodiment illustrated it is preferable to have the artillery shell 1 fin-stabilized and rotating only slightly (by means of the slipping band), it is also feasible within the framework of the invention to provide the artillery shell with conventional, rotation-transmitting bands so that when ejected from a rifled gun barrel it becomes spin-stabilized. With such an embodiment the mortar projectile is provided with the above-mentioned slipping bearing or a similar arrangement to prevent the high rotation of the artillery shell (about 3000–2000 rad/sec) being transmitted to the mortar projectile.

The invention is not restricted to the embodiment illustrated and described, a large number of modifications thereof being feasible within the framework of the appended claims.

I claim:

1. Arrangement for launching a terminally guided fin-stabilized mortar projectile provided with a target seeking arrangement and a path correction arrangement, and comprising: an artillery shell capable of being fired from the rifled barrel of an artillery gun and which is provided with a central, extended cavity; said terminally guided fin-stabilized mortar projectile positioned within said cavity coaxially with the artillery shell; a separation charge provided in the artillery shell which at a desired point in its ballistic path will eject the mortar projectile so that with the aid of the said target seeking arrangement and the path correction arrangement the projectile can subsequently be terminally guided towards a selected target.

2. Arrangement as in claim 1, wherein the artillery shell is provided firstly with a slipping band, and with stabilizing fins arranged to be extended with the artillery shell leaves the barrel.

3. Arrangement as in claim 2, wherein the band and fins impart a speed of rotation to the artillery projectile which is less than 200 rad/sec.

4. Arrangement as in claim 1, wherein the artillery shell is provided with a base bleed unit which is located to the rear of the mortar projectile.

5. Arrangement as in claim 1, including a piston, which is influenced by a separation charge for ejecting the mortar projectile from the artillery shell.

6. Arrangement as in claim 5, including a protective cover which is arranged around the nose of the mortar projectile and which is designed, under the influence of the said piston to eject the mortar projectile.

7. Arrangement in accordance with claim 6, wherein the said piston is arranged to eject both the mortar projectile and the base bleed unit from the artillery shell.

8. Arrangement in accordance with claim 5, wherein the said piston is arranged to eject both the motor projectile and the base bleed unit from the artillery shell.

9. Arrangement as in claim 1, wherein the separation charge is designed to eject the mortar projectile rearwards from the artillery shell so that its velocity is less than that of the artillery shell.

* * * * *